US010380701B2

(12) United States Patent
Lin et al.

(10) Patent No.: US 10,380,701 B2
(45) Date of Patent: Aug. 13, 2019

(54) GENERATING GRAPHICAL PRESENTATIONS USING SKILLS CLUSTERING

(71) Applicant: Microsoft Technology Licensing, LLC, Redmond, WA (US)

(72) Inventors: Song Lin, Santa Clara, CA (US); Cindy Zhou, Mountain View, CA (US); Songtao Guo, Cupertino, CA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 241 days.

(21) Appl. No.: 14/841,495

(22) Filed: Aug. 31, 2015

(65) Prior Publication Data

US 2017/0061550 A1 Mar. 2, 2017

(51) Int. Cl.
*G06Q 50/00* (2012.01)

(52) U.S. Cl.
CPC ..... *G06Q 50/01* (2013.01)

(58) Field of Classification Search
CPC ..... G06Q 50/01
See application file for complete search history.

(56) References Cited

U.S. PATENT DOCUMENTS 8,719,179 B2 * 5/2014 Bonmassar ..... G06Q 10/1053 705/319
9,928,753 B2 * 3/2018 Dozier ..... G09B 7/08
2011/0238591 A1 * 9/2011 Kerr ..... G06Q 10/06 705/321
2012/0059778 A1 * 3/2012 Soykan ..... G06F 19/326 706/12
2012/0197733 A1 * 8/2012 Skomoroch ..... G06Q 30/02 705/14.66
2012/0197863 A1 * 8/2012 Skomoroch ..... G06Q 30/02 707/710
2012/0197993 A1 * 8/2012 Skomoroch ..... G06Q 30/02 709/204
2014/0025427 A1 * 1/2014 Bastian ..... G06Q 30/0201 705/7.29
2014/0279625 A1 * 9/2014 Carter ..... G06Q 50/01 705/319
2014/0297749 A1 * 10/2014 Jayaram ..... G06F 17/30106 709/204
2016/0103885 A1 * 4/2016 Lee ..... G06F 17/30539 707/739

(Continued)

*Primary Examiner* — Eddy Saint-Vil
*Assistant Examiner* — William D Ermlick
(74) *Attorney, Agent, or Firm* — Schwegman Lundberg & Woessner, P.A.

(57) ABSTRACT

Methods and systems for generating tailored user interface presentations based on skills clusters and automatically modified member profiles are presented. According to various embodiments, a set of skills are accessed and a skills matrix generated. A set of co-occurrences among the set of skills are identified. A set of skills clusters is automatically generated based on identifying of the co-occurrences and the skills clusters are automatically validated. A graphical representation of the validated skills cluster is presented with user interface elements for modifying the validated skills cluster and data representing member profiles is presented based on the validated skills cluster.

17 Claims, 12 Drawing Sheets

(56) References Cited

U.S. PATENT DOCUMENTS

2016/0103920 A1* 4/2016 Lee ..... G06F 17/30867
707/706
2016/0110442 A1* 4/2016 Williams ..... G06F 17/30345
707/737
2016/0189404 A1* 6/2016 Edge ..... G06T 11/60
715/202
2016/0203139 A1* 7/2016 Monsch ..... G06F 16/24578
707/749
2016/0292614 A1* 10/2016 Kurjanowicz ... G06Q 10/06398
2016/0292639 A1* 10/2016 Kurjanowicz ..... G06Q 10/105
2016/0371652 A1* 12/2016 Herman ..... G06Q 10/1053

* cited by examiner

GENERATING GRAPHICAL PRESENTATIONS USING SKILLS CLUSTERING

TECHNICAL FIELD

The present disclosure generally relates to the technical field of social-networking systems and, in one embodiment, to analyzing member provided information to generate standardized associated data sets to generate and present tailored user interface presentations.

BACKGROUND

A social networking system, such as LinkedIn, may allow members to declare information about themselves, such as their professional qualifications or skills. In addition to information the members declare about themselves, a social networking system may gather and track information pertaining to behaviors of members with respect to the social networking system and social networks of members of the social networking system. Analyzing a vast array of such information may help to come up with solutions to various problems that may not otherwise have clear solutions.

BRIEF DESCRIPTION OF THE SEVERAL VIEWS OF THE DRAWINGS

Some embodiments are illustrated by way of example and not limitation in the accompanying drawings, in which.

DETAILED DESCRIPTION

Figure 1:
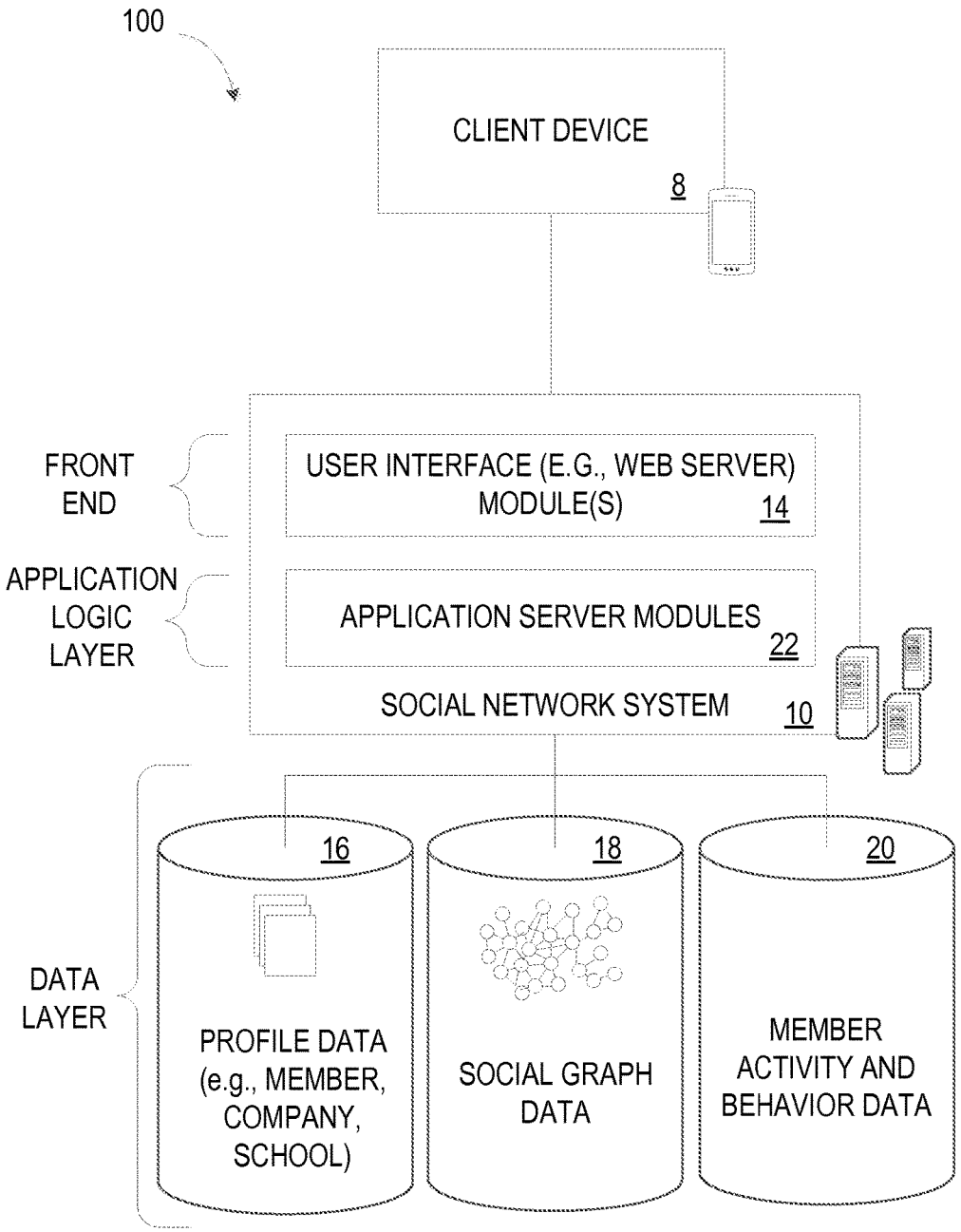
FIG. 1 is a block diagram of the functional modules or components that comprise a computer-network based social network service, including a skills clustering machine consistent with some embodiments described herein.

Example methods and systems for automatically generating skills clusters for use in generating tailored user interface presentations are described. Methods and systems described herein may increase visibility of member profiles of a social networking system in search results on the social networking system or other search engines operating on a network such as the Internet. As described in more detail below, the methods and systems of the present disclosure may enable mining of additional data from member profiles previously where the data was previously unavailable. For example, based on a makeup of the members of the social networking system, methods and systems described herein may identify previously undetected similarities and automatically generate new data or modify data of the member profiles in order to facilitate identification in search results or mining of data from member profiles or associations among member profiles. In some instances, the associations among the member profiles may be associations of which members of the social networking system may be unaware and had not previously indicated within their member profile. Further, systems and methods of the present disclosure may generate tailored user interface presentations, such as graphical and textual representations of skills clusters, member profiles, and interrelations among the member profiles based on the skills clusters. In the following description, for purposes of explanation, numerous specific details are set forth in order to provide a thorough understanding of example embodiments. It will be evident, however, to one skilled in the art that the embodiments of the present disclosure may be practiced without these specific details.

Social networking services provide various profile options and services. In some instances a social network may connect members (e.g., individuals associated with the social network) and organizations alike. Social networking services have also become a popular method of performing organizational research and job searching. Job listings representing openings (e.g., employment and volunteer positions) within an organization may be posted and administered by the organization or third parties (e.g., recruiters, employment agencies, etc.).

A social networking system may have a vast array of information pertaining to members of the social networking system and companies maintaining a social networking presence on the social networking system. As will be discussed in more detail below, information pertaining to members of the social networking system can include data items pertaining to education, work experience, skills, reputation, certifications, or other qualifications of each of the members of the social networking system and at particular points during the careers of these members. This information pertaining to members of the social networking system may be member generated to enable individualization of social networking profiles as well as to enable dynamic and organic expansion and discovery of fields of experience, education, skills, and other information relating to personal and professional experiences of members of the social networking system.

A member of a social networking system may seek other members of a social networking system for job openings, professional connections, social connections, or other purposes by attempting to identify members or companies maintaining a presence on the social networking system through member generated descriptions within a set of member or company profiles stored on the social networking system. However, information pertaining to members of the social networking system, taking the form of member generated skills descriptions, can include variations in wording, spelling and grammar mistakes, inconsistencies or omissions, and other non-standard values based on the organic expansion of a collective set of skills and member descriptions. These inconsistencies, variations, and mistakes, may preclude or obscure identification of intended or appropriate member profiles or may cause a set of search results to include false positives, identifying members or companies not well suited to the search criteria. Member generated skills descriptions may be standardized and clustered to enable removal of false positives as well as enable efficient and accurate identification of intended member profiles, without modification of visible member or company profiles while maintaining organic growth of fields of study, profession, and experience.

In generating validated skills clusters, in various embodiments, a skills clustering machine analyzes vast amounts of data representing careers, qualifications, skills, experience, education, hobbies, interests, and other characteristics of members of the social networking system to identify. The skills clustering may generate a standardized set of skills or access a previously generated standardized set of skills. The skills clustering machine may then generate skills clusters based on co-occurrences of two or more skills within the member and company profiles of the social networking system. Skills clusters may be validated using various operations of the skills clustering machine. In some instances, validated skills clusters may be graphically or textually represented and submitted for revision based on one or more of a set of automated processes or administrators of the social networking system.

In some embodiments, standardized sets of skills and validated skills clusters may facilitate generation of talent indexes, identifying talent by skill sets across varying geographical locations, identification of members for available positions, generating market research reports, and generating robust and validated skills clusters. In some instances, skills clustering enables generation of skills reports to suggest additional skills to supplement current member skill sets.

Other aspects of the present inventive subject matter will be readily apparent from the description of the figures that follow.

FIG. 1 is a block diagram of the functional modules or components that comprise a computer- or network-based social networking system 10 consistent with some embodiments of the inventive concepts of the present disclosure. As shown in FIG. 1, the social networking system 10 is generally based on a three-tiered architecture, comprising a front-end layer, application logic layer, and data layer. As is understood by skilled artisans in the relevant computer and Internet-related arts, each module or engine shown in FIG. 1 represents a set of executable software instructions (e.g., an instruction set executable by a processor) and the corresponding hardware (e.g., memory and processor) for executing the instructions. To avoid obscuring the inventive subject matter, various functional modules and engines that are not germane to conveying an understanding of the inventive subject matter have been omitted from FIG. 1. However, a skilled artisan will readily recognize that various additional functional modules and engines may be used with a social networking system 10, such as that illustrated in FIG. 1, to facilitate additional functionality that is not specifically described herein. Furthermore, the various functional modules and engines depicted in FIG. 1 may reside on a single server computer, or may be distributed across several server computers in various arrangements. Moreover, although depicted in FIG. 1 as a three-tiered architecture, the inventive subject matter is by no means limited to such architecture.

As shown in FIG. 1, the front end comprises a user interface module 14 (e.g., a web server), which receives requests from various client-computing devices 8, and communicates appropriate responses to the requesting client devices 8. For example, the user interface module 14 may receive requests in the form of Hypertext Transport Protocol (HTTP) requests, or other web-based, application programming interface (API) requests. The client devices 8 may be executing conventional web browser applications, or applications that have been developed for a specific platform to include any of a wide variety of mobile devices and operating systems.

As shown in FIG. 1, the data layer includes several databases, including one or more databases 16 for storing data relating to various entities represented in a social graph. With some embodiments, these entities include members, companies, and/or educational institutions, among possible others. Consistent with some embodiments, when a person initially registers to become a member of the social network service, and at various times subsequent to initially registering, the person will be prompted to provide some personal information, such as his or her name, age (e.g., birth date), gender, interests, contact information, home town, address, the names of the member's spouse and/or family members, educational background (e.g., schools, majors, etc.), current job title, job description, industry, employment history, skills, professional organizations, and so on. This information is stored as part of a member's member profile, for example, in the database 16. With some embodiments, a member's profile data will include not only the explicitly provided data, but also any number of derived or computed member profile attributes and/or characteristics.

Once registered, a member may invite other members, or be invited by other members, to connect via the social network service. A "connection" may use a bi-lateral agreement by the members, such that both members acknowledge the establishment of the connection. Similarly, with some embodiments, a member may elect to "follow" another member. In contrast to establishing a "connection", the concept of "following" another member typically is a unilateral operation, and at least with some embodiments, does not include acknowledgement or approval by the member that is being followed. When one member follows another, the member who is following may receive automatic notifications about various activities undertaken by the member being followed. In addition to following another member, a user may elect to follow a company, a topic, a conversation, or some other entity. In general, the associations and relationships that a member has with other members and other entities (e.g., companies, schools, etc.) become part of the social graph data maintained in a database 18. With some embodiments a social graph data structure may be implemented with a graph database 18, which is a particular type of database that uses graph structures with nodes, edges, and properties to represent and store data. In this case, the social graph data stored in database 18 reflects the various entities that are part of the social graph, as well as how those entities are related with one another.

With various alternative embodiments, any number of other entities might be included in the social graph, and as such, various other databases may be used to store data corresponding with other entities. For example, although not shown in FIG. 1, consistent with some embodiments, the system may include additional databases for storing information relating to a wide variety of entities, such as information concerning various online or offline groups, job listings or postings, photographs, audio or video files, and so forth.

With some embodiments, the social network service may include one or more activity and/or event tracking modules, which generally detect various user-related activities and/or events, and then store information relating to those activities/events in the database with reference number 20. For example, the tracking modules may identify when a user makes a change to some attribute of his or her member profile, or adds a new attribute. Additionally, a tracking module may detect the interactions that a member has with different types of content. Such information may be used, for example, by one or more recommendation engines to tailor the content presented to a particular member, and generally to tailor the user experience for a particular member.

The application logic layer includes various application server modules, which, in conjunction with the user interface module 14, generates various user interfaces (e.g., web pages) with data retrieved from various data sources in the data layer. With some embodiments, individual application server modules are used to implement the functionality associated with various applications, services and features of the social network service. For instance, a messaging application, such as an email application, an instant messaging application, a social networking application native to a mobile device, a social networking application installed on a mobile device, or some hybrid or variation of these, may be implemented with one or more application server modules implemented as a combination of hardware and software elements. Of course, other applications or services may be separately embodied in their own application server modules.

As shown in FIG. 1, a skills clustering machine 22 is an example application server module of the social networking system 10. The skills clustering machine 22 performs operations to automatically generate skills clusters and validate the generated skills clusters to provide linking among skills listed in member profiles generated by members of the social networking system 10. In some embodiments, the skills clustering machine 22 operates in conjunction with the user interface modules 14 to receive member input and generate tailored user interface presentations based on the validated skills clusters. For example, the skills clustering machine 22 may generate graphical representations of skills clusters and the skills contained in the cluster for revision by subject matter experts or designated administrators of the social networking system 10. By way of further example, the skills clustering machine 22 identifies members of the social networking system 10 based on the generated and validated skills clusters and generates graphical user interface elements (e.g., input fields, buttons, web pages, or graphical user interface documents presented via a browser, window, or application) to present one or more of a set of member profiles of the social networking system 10. The skills clustering machine 22 may also cause presentation of other information relating to the identified set of member profiles, as will be explained in more detail below.

The social networking system 10 may provide a broad range of applications and services that allow members the opportunity to share and receive information, often customized to the interests of the member. For example, with some embodiments, the social networking system 10 may include a photo sharing application that allows members to upload and share photos with other members. As such, at least with some embodiments, a photograph may be a property or entity included within a social graph. With some embodiments, members of a social networking system 10 may be able to self-organize into groups, or interest groups, organized around a subject matter or topic of interest. Accordingly, the data for a group may be stored in a database (not shown). When a member joins a group, his or her membership in the group will be reflected in the social graph data stored in the database 18. With some embodiments, members may subscribe to or join groups affiliated with one or more companies. For instance, with some embodiments, members of the social networking system 10 may indicate an affiliation with a company at which they are employed, such that news and events pertaining to the company are automatically communicated to the members. With some embodiments, members may be allowed to subscribe to receive information concerning companies other than the company with which they are employed. Here again, membership in a group, a subscription or following relationship with a company or group, as well as an employment relationship with a company, are all examples of the different types of relationships that may exist between different entities, as defined by the social graph and modelled with the social graph data of the database 18.

Figure 2:
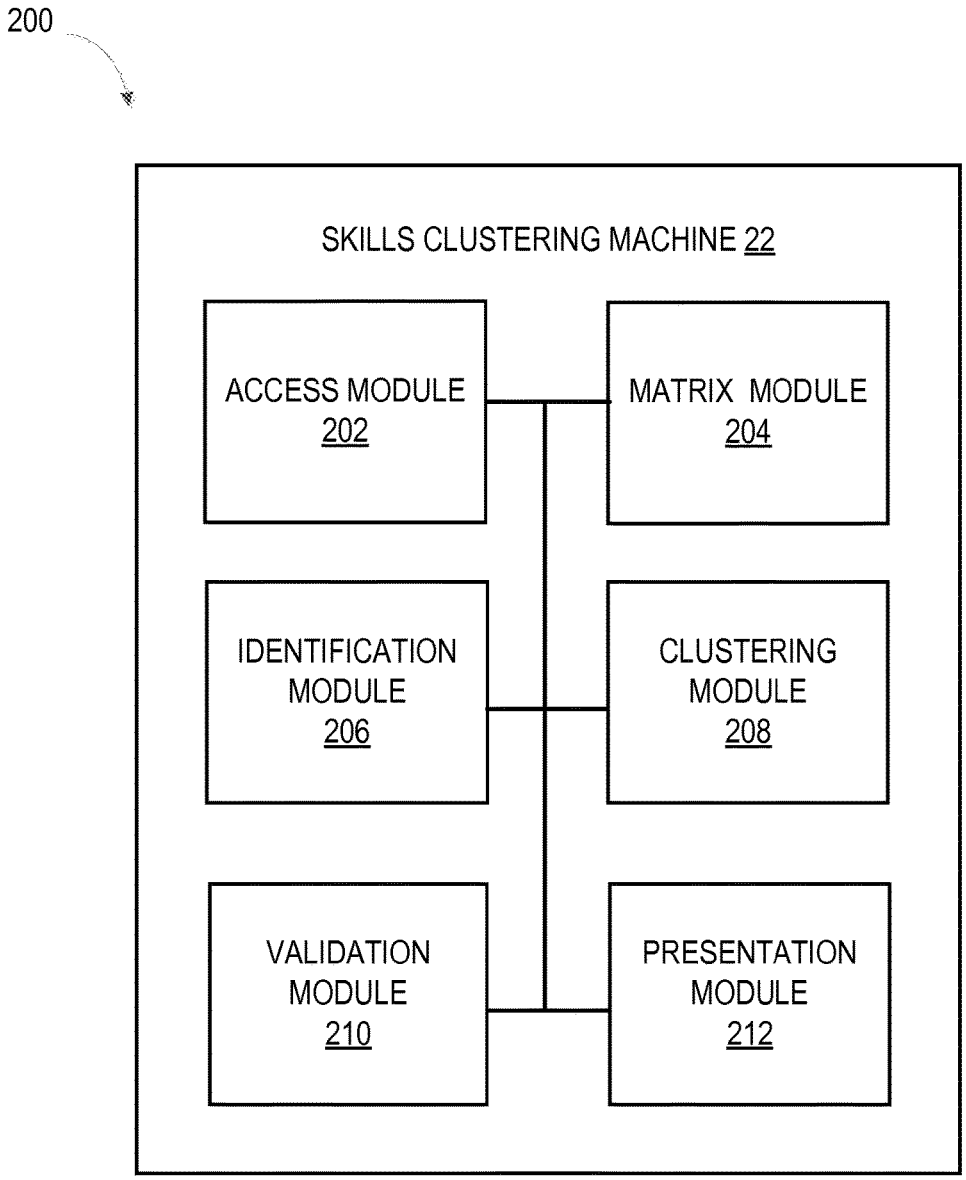
FIG. 2 is a block diagram depicting some example modules of the skills clustering machine of FIG. 1.

FIG. 2 is a block diagram depicting some example modules of the skills clustering machine 22 of FIG. 1. The skills clustering machine 22 is shown including an access module 202, a matrix module 204, an identification module 206, a clustering module 208, a validation module 210, and a presentation module 212 all configured to communicate with each other (e.g., via a bus, shared memory, a switch, or a network). Any one or more of the modules described herein may be implemented using hardware (e.g., one or more processors specifically configured to perform the operations described herein) or a combination of hardware and software, forming a hardware-software implemented module. For example, any module described herein may configure a processor (e.g., among one or more processors of a machine) as a special purpose machine, during the pendency of a set of operations, to perform the operations described herein for that module. Moreover, any two or more of these modules may be combined into a single module, and the functions described herein for a single module may be subdivided among multiple modules. Furthermore, according to various example embodiments, modules described herein as being implemented within a single machine, database, or device may be distributed across multiple machines, databases, or devices.

The access module 202 accesses sets of skills stored on the database 16 of the social networking system 10. In various example embodiments, the access module 202 accesses a set of member profiles of the social networking system 10 to access the sets of skills, while in other embodiments, the access module 202 accesses the set of skills in a separate database or separate portion of database 16, such that the entirety of the skills identified for all members of the social networking system 10 are represented in the separated database or portion of database 16. In some embodiments, the access module 202 accesses the sets of skills via a network connection between the social networking system 10 and the skills clustering machine 22, where the skills clustering machine 22 is implemented in a standalone or otherwise networked relationship to the social networking system 10.

The matrix module 204 generates a skills matrix for the set of skills stored on the database 16. The matrix module 204 may generate the matrix such that each of the skills represented in the set of skills is correlated with each of the other skills in the set of skills. For example, in some instances, the skills matrix is represented as an array of skills with each skill serving as a column and a row of the array. In various embodiments, the skills matrix is not explicitly constructed, but pair-wise similarity is determined among co-occurring skills of the set of skills. For example, a series of map-reduce operations may be performed using member profiles of the social networking system 10 as input. Individual skill frequency and skill-pair co-occurrence are computed in parallel, and pair-wise Jaccard similarities are derived for each skill in relation to other skills with which each skill co-occurs. The result of the derived Jaccard similarities may be understood as a graph adjacency matrix. Once generated, the matrix module 204 may store the matrix on the database 16, or on any other suitable database or within any suitable data structure accessible by the skills clustering machine 22. The matrix module 204 may dynamically update the skills matrix upon detecting additional skills being added to the database 16 and upon co-occurrence scores being generated for the matrix, as will be explained in more detail below. In embodiments where the matrix module 204 generates an explicit matrix construct, the skills matrix is stored within the database 16 as a data structure. Where the matrix module 204 does not explicitly generate a matrix construct, data representative of the matrix and co-occurrence between the set of skills may be stored within the set of skills, metadata associated with the set of skills, the set of member profiles, or any other suitable data structure.

The identification module 206 identifies co-occurrences, within a set of member profiles of the social networking system 10, of two or more skills of the set of skills in the skills matrix. Co-occurrences may be understood as the occurrence or presence of two or more skills within a member profile of the social networking system 10. For example, where the skills of JAVA® programming and PYTHON® programming occur in the same member profile, these skills are identified as co-occurring in the member profile. In some instances, the identification module 206 identifies co-occurrences using collaborative filtering. In various embodiments, the identification module 206 uses cosine similarity, such as by calculating a Jaccard similarity coefficient or the Jaccard index. In some embodiments, the identification module 206 generates a co-occurrence score for each skill of the set of skills. In some embodiments, the co-occurrence score may represent pairwise similarities among two or more skills of the set of skills, as discussed in more detail below. In some instances the co-occurrence scores may be understood as a metric to measure similarity among skills.

The clustering module 208 generates a set of skills clusters based on receiving an indication of co-occurrences of skills detected by the identification module 206. The clustering module 208 may cluster the skills using spectral clustering, Laplacian Matrix Decomposition, K-means, hierarchical clustering, balanced iterative reducing and clustering using hierarchies (BIRCH), an expectation-maximization algorithm, or other suitable operations. In some embodiments, the clustering module 208 receives an output of the identification module (e.g., the identification of the co-occurrences of the set of skills and the co-occurrence scores for each of the skills) to derive a diagonal degree matrix, transforming the diagonal degree matrix into a Laplacian matrix, and conducting matrix decomposition. The clustering module 208 may then perform one or more operations on an eigenspace of the Laplacian matrix to generate the set of skills clusters.

The validation module 210 validates skills clusters to generate or mark validated skills clusters. The validation module may perform validation operations including silhouette indexing to identify consistency within the skills clusters. Upon determining a skills cluster contains an inconsistent skill or set of skills, the validation module 210 may reassign the inconsistent skill or skills to another skills cluster, disassociate the inconsistent skills from the skills cluster, or otherwise remove the inconsistent skills. In some instances, the validation module 210 identifies inconsistent skills and generates an alert for the clustering module 208 to reevaluate the skills cluster. In some instances, the validation module 210 generates an alert for the clustering module 208 and removes any inconsistent skills. The alert may indicate a rule or exception identified for the inconsistent skill or skills to be incorporated in the machine learning operations of the clustering module 208 for future clustering operations.

The presentation module 212 causes presentation of data representing a validated skills cluster at a client device 8. Causing presentation of the validated skills cluster or representative data can include generating graphical representations of the validated skills cluster or textual representations of the validated skills cluster. In some embodiments, causing presentation of data representative of the validated skills cluster includes identifying and displaying member profiles associated with the validated skills cluster or data representative of demographic trends, employment trends, or other skills related statistics for skills associated with the validated skills cluster.

Figure 3:
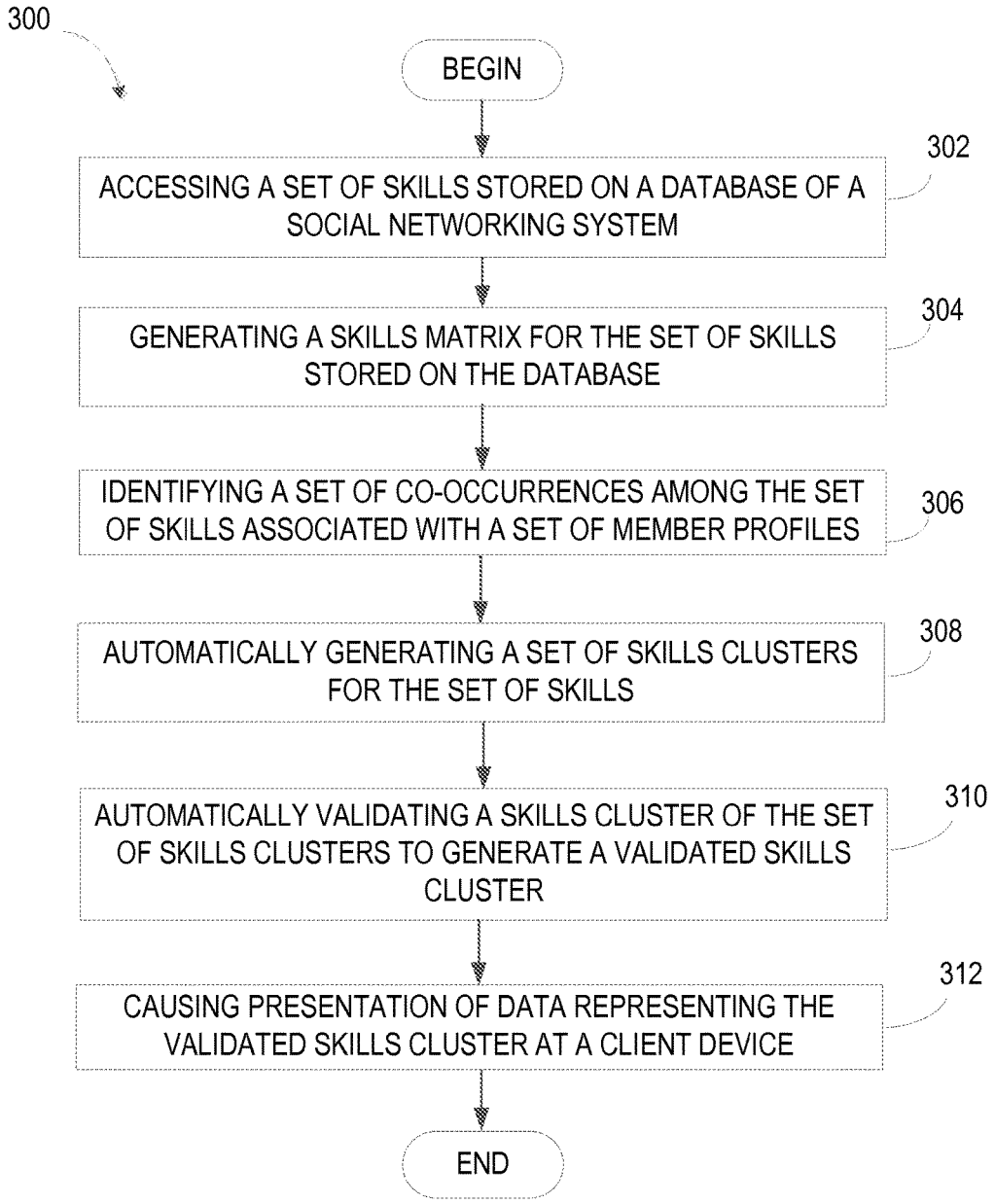
FIG. 3 is a flow diagram illustrating an example method of automated skills cluster generation.

FIG. 3 is a flow diagram illustrating an example method 300 of automated skills cluster generation, consistent with various embodiments described herein. The method 300 may be performed at least in part by, for example, the skills clustering machine 22 illustrated in FIG. 2 (or an apparatus having similar modules, such as one or more client machines or application servers).

In operation 302, the access module 202 accesses a set of skills stored on a database of a social networking system. In various embodiments, the set of skills are stored on the database 16. For example, in embodiments where the skills clustering machine 22 and the database 16 are part of the social networking system 10, the access module 202 may directly access the database 16 of the social networking system 10 to retrieve or otherwise access the set of skills. In some embodiments, where the database is part of a system other than the social networking system 10 or is remote from the skills clustering machine 22, the access module 202 accesses the set of skills stored on the database 16 by transmitting a request for at least a portion of the set of skills, and receiving at least a portion of the set of skills, or data representing at least a portion of the set of skills from the database 16 via the network. The set of skills may be stored as part of the set of member profiles of the social networking system 10. For example, the member profiles for the social networking system 10 may be stored on the database 16 with the set of skills being distributed among the set of member profiles.

In some embodiments, the set of member profiles include member generated skills or member generated skills descriptions. These member generated skills may be received from a member of the social networking system 10 to populate a member profile and to describe the skills, experiences, education, and background of the member. In some instances, the set of skills stored on the database 16 may be the member generated skills, and the access module 202 accesses the member generated skills in operation 302. As such, the set of skills may be distributed among the set of member profiles of the social networking system 10 and may be composed of input received from all or a plurality of the members of the social networking system 10. In some embodiments, in addition to the member generated skills, the access module 202 may access additional functions of the social networking system 10 to identify skills and relationships among skills. For example, the access module 202 may access endorsed skills and relationships among endorsed skills for input for the matrix module 204 and the identification module 206.

In some embodiments, the set of skills stored on the database 16 is a set of standardized skills representing the set of member generated skills. The set of standardized skills may represent a formalized listing of skills. For example, the social networking system 10 may include a large number of skills generated by members. In some instances, these member generated skills may be include false variations such as variations in wording, typographical or grammatical mistakes, semantically related descriptions, redundant descriptions, and the like. The set of standardized skills may include a representative list of the member generated skills corrected and consolidated for mistakes, redundancy, and word variance which does not amount to a significantly different skill. For example, the social networking system 10 may include 600 million member generated skills within the set of member generated skills. In some embodiments, the identification module 206 reduces the set of member generated skills to the set of standardized skills, such that the set of standardized skills is the set of all unique skills within the set of member generated skills, reduced and consolidated for corrections and redundancy. The set of standardized skills may be fewer in number (e.g., around 39,000 standardized skills) than the set of member generated skills.

In various embodiments, the operation 302 is performed in response to a scheduled and automated skills clustering function of the skills clustering machine 22, a request for skills clustering received from an administrator, or a detection of a modification of the set of skills exceeding a predetermined threshold. For example, the operation 302 may be scheduled to be performed during a scheduled system down time for the social networking system 10 or based on usage of the social networking system 10 falling below a predetermined traffic level.

In operation 304, the matrix module 204 generates a skills matrix for the set of skills stored on the database 16. In some embodiments, the matrix includes a data structure such as a relational database including the set of skills and providing a structure to identify a relationship among the set of skills. For example, the relational database may provide intersections among skills indicating a co-occurrence of those skills (e.g., two of the skills occurring within the same member profile). In some instances, the matrix may be generated as a data structure separate from the set of skills or the set of member profiles. In some instances a representation of the matrix may be generated by generating tags or fields for each of the skills of the set of skills. The tags or fields may provide information representing relationships among the set of skills. For example a tag or field may include a value or link indicating an association of a skill with all of the other skills with which that skill co-occurs in one or more member profile. As discussed above, in some instances, the matrix module 204 may generate a new data structure for the matrix and store the new data structure within the database 16 or the database 18. In some embodiments, the matrix module 204 modifies the member profiles or data representing skills within the member profiles by storing the matrix as a set of fields or tags distributed within the member profiles or set of skills.

The operation 304 may be performed in response to the operation 302 being performed. For example, once the access module 202 performs the operation 302, the access module 202 may generate a system interrupt or scheduling event to cause the matrix module 204 to automatically generate a new matrix or modify an existing matrix. For example, access module 202 may schedule the matrix module 204 to perform the operation 304 during a scheduled downtime or update period for the social networking system 10, or for a time period subject to usage below a predetermined threshold.

In operation 306, the identification module 206 identifies a set of co-occurrences among the set of skills associated with a set of member profiles. In some instances, the identification module 206 may use collaborative filtering operations to identify co-occurrences. In some embodiments, the identification module 206 may identify the set of co-occurrences by parsing the set of member profiles to determine if two skills co-occur on a member's profile. The identification module 206 may parse the set of skills based on matching instances of skills within member profiles (e.g., matching keywords or an identification number associated with a skill), semantic similarity (e.g., natural language processing operations), or any other suitable method.

The operation 306 may be an automated operation or set of operations performed without user or administrator intervention. For example, the operation 306 may be initiated in response to generating the matrix in operation 304 or the access of the set of skills in operation 302. For example, where the matrix module 204 has previously generated a matrix, the identification module 206 may initiate the identification of the set of co-occurrences prior to the matrix module 204 completing any modification operations on the previously generated matrix in operation 304.

In operation 308, the clustering module 208 generates a set of skills clusters for the set of skills. The operation 308 may be automatically performed based on identifying the set of co-occurrences without user or administrator intervention. In some embodiments, the clustering module 208 generates the set of skills clusters using one or more spectral clustering operations, such as using the Shi-Malik algorithm (e.g., a normalized cuts algorithm). For example, the clustering module 208 may use Laplacian Matrix Decomposition, K-means, hierarchical clustering, balanced iterative reducing and clustering using hierarchies (BIRCH), expectation-maximization algorithm, or other suitable operations. In some embodiments, the clustering module 208 generates the set of skills clusters using the discussed algorithms in an unsupervised machine learning environment. The unsupervised machine learning environment may enable the clustering module 208 to generate the set of clusters with no training signal.

Figure 4A:
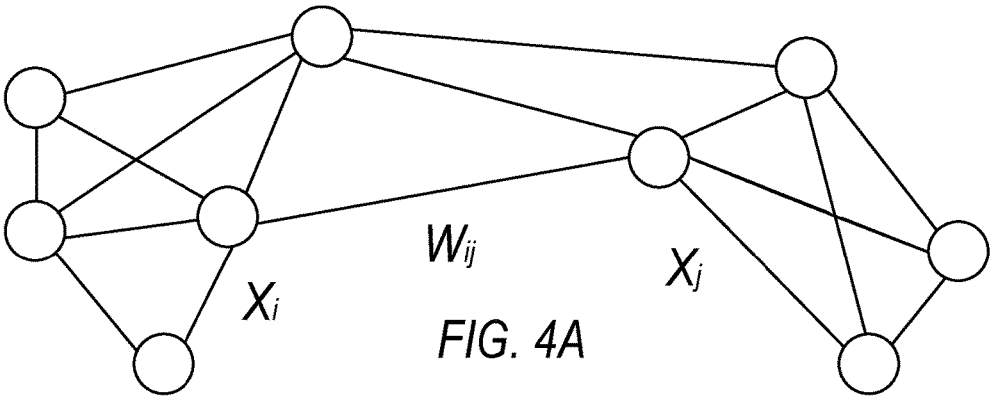
FIG. 4A is a block diagram of a set of skills being clustered.
Figure 4B:
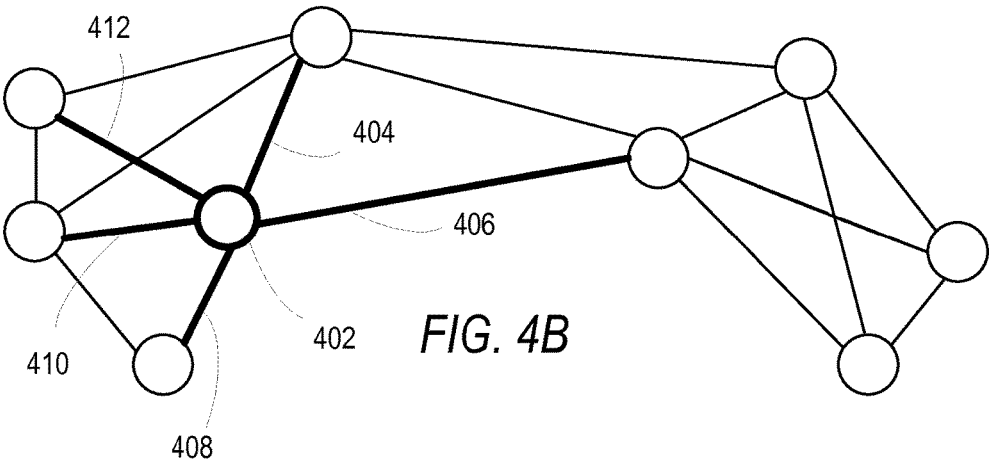
FIG. 4B is a block diagram of the set of skills of FIG. 4A being clustered.

For example, as shown in FIGS. 4A and 4B, an example set of skills is shown in a skills where a node 402, such as $x_i$ and $x_j$, represents a skill and edges 402-412 represent co-occurrences among the connected nodes. As shown in FIG. 4A, an edge (e.g., the edge 406 of FIG. 4B) may be associated with a weight, $w_{ij}$.

$$D(x_i) = \sum_{j \in V} w_{ij}$$

The weight may correspond to a pairwise similarity or distance. The clustering module 208 may determine a degree of the node 402 using the equation 1, shown below.

Figure 4C:
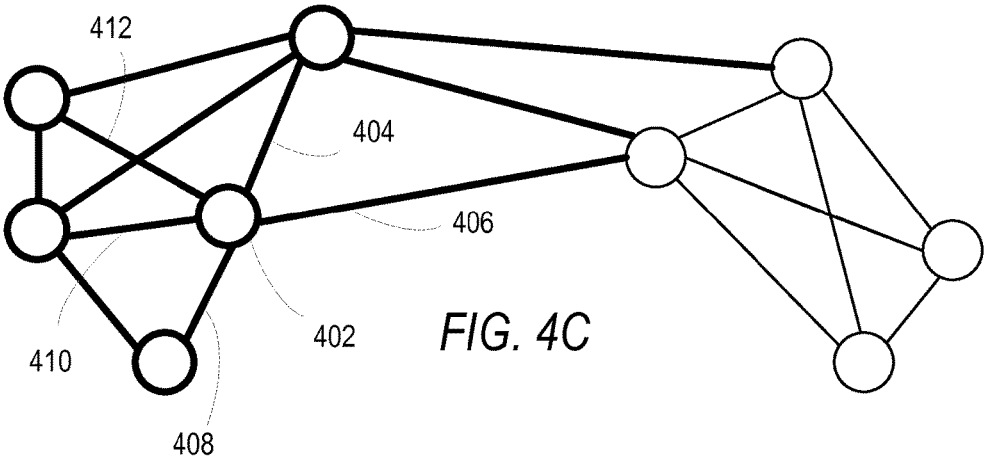
FIG. 4C is a block diagram of the set of skills of FIG. 4A being clustered.

A representation of determining a degree of the node 402 is shown in FIG. 4B. The clustering module 208 may also determine a volume of a potential cluster, as shown in FIG. 4C. The clustering module 208 may determine the $$Vol(C) = \sum_{i \in C} D(x_i)$$

volume of the set using equation 2, shown below.

Figure 4D:
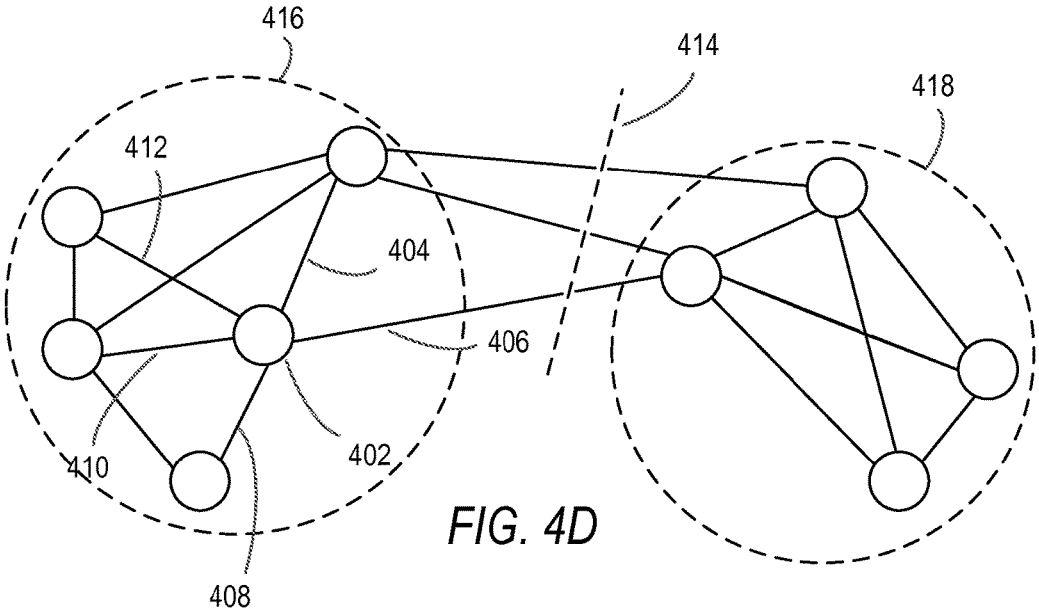
FIG. 4D is a block diagram of the set of skills of FIG. 4A being clustered.

As shown in FIG. 4D, the clustering module 208 may determine a cut between two sub-graphs or sub-clusters 416 and 418. The cut between sub-clusters 416 and 418, along line 414, may be determined using equation 3, shown below.

Figure 4E:
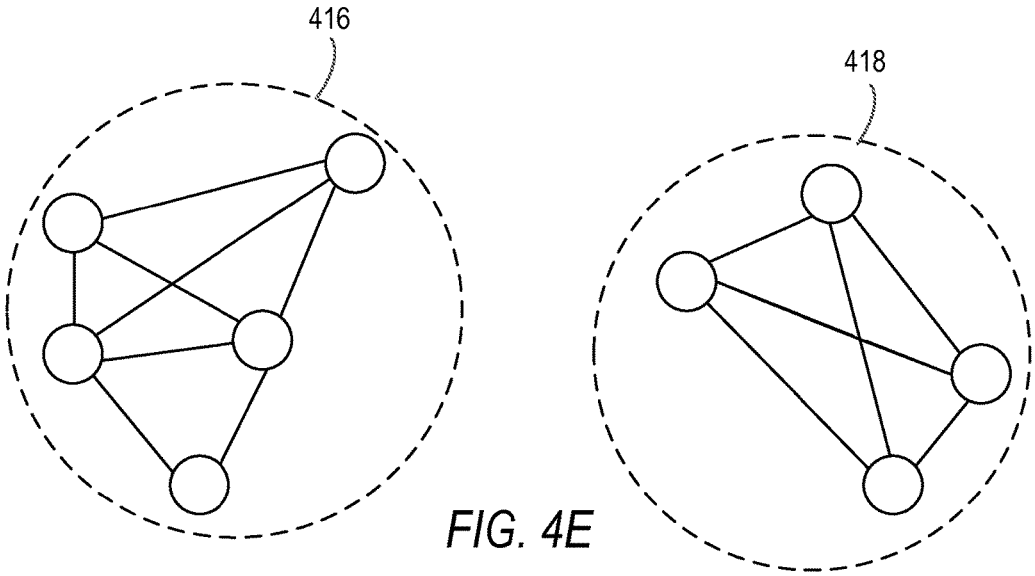
FIG. 4E is a block diagram of the set of skills of FIG. 4A being clustered.

The clustering module 208 may determine a minimum set of cuts among $$\mathrm{Cut}(C_1, C_2) = \sum_{i \in C_1} \sum_{j \in C_2} w_{ij}$$

the set of skills to partition the set of skills into the set of skills clusters. In some embodiments, using spectral clustering the clustering module 208 may recursively partition the set of skills, identify a minimum cut, and remove edges, as shown in FIG. 4E. The clustering module 208 may repeat these operations until the clustering module 208 generates a suitable number of clusters.

As another example, of the operations which may be performed by the clustering module 208 in generating the set of skills clusters using spectral clustering is as follows:

input graph adjacency matrix A, number k a. form diagonal matrix D b. form unormalized Laplacian L=D−A c. compute the first k eigenvectors $u_1, \ldots, u_k$ of L d. form matrix $U \in R_{n \times k}$ with columns $u_1, \ldots, u_k$ e. consider the i-th row of U as point $y_i \in R_k$, i=1, . . . , n f. cluster the points $\{y_i\}_{i=1, \ldots, n}$ into clusters $C_1, \ldots, C_k$ e.g., with k-means clustering output clusters $A_1, \ldots, A_k$ with $A_i = \{j | y_j \in C_i\}$ As shown in the example pseudo code section, the graph adjacency matrix A may be the skills matrix generated in operation 304 and the clustering module 208 may output the set of skills clusters $A_1 \ldots A_k$.

Figure 5:
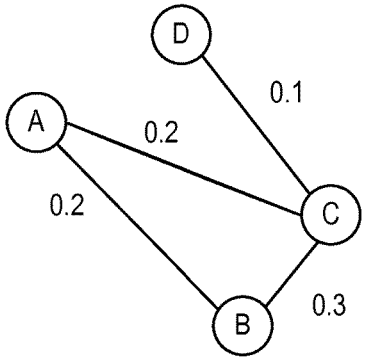
FIG. 5 is a block diagram of a set of skills being clustered.

Using the operations outlined above, the clustering module 208 may generate a cluster for a set of skills A, B, C, and D, as shown in FIG. 5. The clustering module 208 may calculate the weight for the set of skills to generate table 1.

TABLE 1

| | A | B | C | D |
|---|---|---|---|---|
| A | 0.4 | 0.2 | 0.2 | 0.0 |
| B | 0.2 | 0.5 | 0.3 | 0.0 |
| C | 0.2 | 0.3 | 0.6 | 0.1 |
| D | 0.0 | 0.0 | 0.1 | 0.1 |

The clustering module 208 may calculate the degree for the set of skills to generate table 2.

TABLE 2

| | A | B | C | D |
|---|---|---|---|---|
| A | 0.4 | 0.0 | 0.0 | 0.0 |
| B | 0.0 | 0.5 | 0.0 | 0.0 |
| C | 0.0 | 0.0 | 0.6 | 0.0 |
| D | 0.0 | 0.0 | 0.0 | 0.1 |

The clustering module 208 may then compute the eigenvectors and form the matrix.

In operation 310, the validation module 210 validates a skills cluster of the set of skills clusters to generate a validated skills cluster. The validation module 210 may generate a cluster score to evaluate whether the skills cluster being validated is similar to another skills cluster of the set skills clusters. In some embodiments, the validation module 210 validates each skills cluster of the set of skills clusters, generating cluster scores for each of the skills clusters and comparing the cluster scores for each of the skills clusters to all of the others in the set of skills clusters. Operation 310 may be performed automatically, without user or administrator intervention or prompting based on generating the set of skills clusters. For example, the clustering module 208 may generate a system interrupt causing the validation module 210 to initiate operation 310 upon generation of the set of skills clusters. In some instances, the clustering module 208 may pass one or more of the set of skills clusters, data representative of the set of skills clusters, a notification of completion of the operation 308, or other indication that the set of skills clusters have been generated and are to be validated.

In performing operation 310, in some embodiments, the validation module 210 performs one or more operations of Silhouette indexing. The operation 310 may measure the quality of a skills cluster and be used as a guide to tune skills clustering operations such as operation 308 or skills clustering mechanisms such as the clustering module 208. The Silhouette indexing operations may identify tightly clustered skills within a skills cluster and skills which are not tightly clustered. Those skills which are not tightly clustered may be removed from the skills cluster. In some instances, the validation module 210 determines tightly clustered skills based on generation of a similarity score or dissimilarity score and determining or receiving a threshold score. Skills having a score outside of the threshold score, may be understood as not tightly clustered within a particular skills cluster and be removed from the skills cluster.

In operation 312, the presentation module 212 causes presentation of data representing the validated skills cluster at a client device (e.g., the client device 8). In some embodiments, the presentation module 212 causes presentation of the validated skills cluster by transmitting a graphical representation of the validated skills cluster to the client device 8. The presentation module 212 may generate one or more documents, web pages, or graphical user interface elements to present the validated skills cluster. In some instances, the presentation module 212 generates text describing one or more aspects of the graphical representation of the validated skills cluster for presentation along with or in lieu of the validated skills cluster. For example, in some instances, presentation module 212 identifies skills or a subset of skills represented by nodes within the validated skills cluster. The presentation module 212 may generate a formatted document, web page, or graphical user interface element for presentation at the client device 8. The skills may be presented in a hierarchical format, an expanded graphical representation of the validated skills cluster, a word cloud, or other suitable presentation of the skills.

Figure 6:
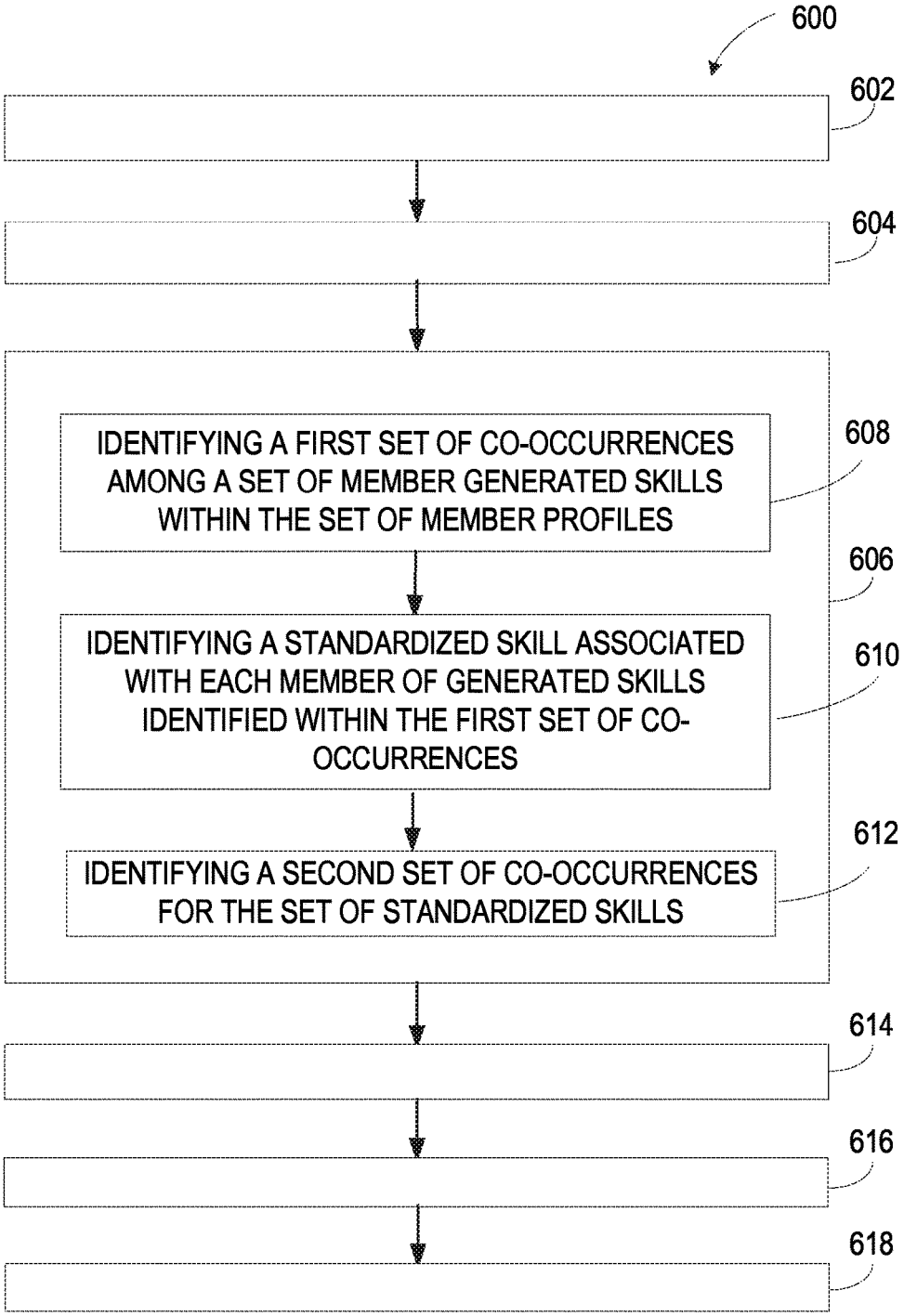
FIG. 6 is a flow diagram illustrating an example method of identifying skills co-occurrence during automated skills cluster generation.

FIG. 6 is a flow diagram illustrating an example method 600 of identifying skills co-occurrence during automated skills cluster generation, consistent with various embodiments described herein. The method 600 may be performed at least in part by, for example, the skills clustering machine 22 illustrated in FIG. 2 (or an apparatus having similar modules, such as one or more client machines or application servers). In some embodiments, the method 400 includes one or more operations from the method 300.

For example, as shown the method 600 is initially performed by operations 602 and 604. In operation 602, the access module 202 accesses a set of skills stored on a database of a social networking system. Operation 602 may be performed similarly to or the same as operation 302, described above. In operation 604, the matrix module 204 generates a skills matrix for the set of skills stored on the database. The operation 604 may be performed similarly to or the same as operation 304, described above.

In operation 606, the identification module 206 identifies a set of co-occurrences among the set of skills associated with a set of member profiles. As shown in FIG. 6, in some embodiments, the operation 606 includes one or more sub-operations. In operation 608, the identification module 206 identifies a first set of co-occurrences among a set of member generated skills within the set of member profiles. In some embodiments, the identification module 206 may identify the first set of co-occurrences by parsing the set of member generated skills, similarly to the manner described with respect to the operation 306. For example, the identification module 206 may determine the first set of co-occurrences using collaborative filtering operations, such as item-to-item collaborative filtering. Although discussed with respect to member generated skills, the identification module 206 may also identify co-occurrences in other sets of skills, such as endorsed skills, skills on other social networking systems, and other functions or data generated by the social networking system 10 relating to skills, classifications, experiences, qualifications, and the like.

In operation 610, the identification module 206 identifies a standardized skill associated with each of the member generated skills identified within the first set of co-occurrences. In some embodiments, a set of standardized skills is stored in a data structure on the database 16. Within the data structure, the set of standardized skills may include one or more link, tag, or other data associating each of the standardized skills with one or more member generated skills. The identification module 206 may identify the standardized skills by accessing the database 16 to identify one or more standardized skills which are associated with each of the member generated skills identified within the first set of co-occurrences. In some embodiments, the operation 4610 is automatically triggered by completion of the operation 608. For example, the identification of the first set of co-occurrences may generate a system interrupt to cause the skills clustering machine 22 to perform the operation 410. In some instances, while the skills clustering machine 22 is configured to perform the operations of the identification module 206, the identification of the first set of co-occurrences may generate an instruction to continue to operation 610 and maintain the skills clustering machine 22 in the current configuration using the identification module 206.

In operation 612, the identification module 206 identifies a second set of co-occurrences for the set of standardized skills, based on identifying the first set of co-occurrences and identifying the standardized skill associated with each of the member generated skills. In some embodiments, the identification module 206 identifies the second set of co-occurrences by identifying the set of standardized skills associated with the identified member generated skills, in operation 610 and then identifying any co-occurrences of the standardized skills among the set of member profiles. In some instances, the identification module 206 identifies the second set of co-occurrences for the set of standardized skills by identifying a first set of standardized skills associated with the identified member generated skills, in operation 610, and including in the second set of co-occurrences a second set of standardized skills associated with the first set of standardized skills. The second set of standardized skills may be identified for incorporation based on links, tags, hierarchical nesting, or other data or relationships among the standardized skills.

In some example embodiments, the operations 608, 610, and 612 may be automatically performed based on one or more of the operations 602 and 604. Further, in some embodiments, the operations of the method 600 may be performed automatically by the system based on the skills clustering machine 22 receiving a selection from the user interface 14 of a request for skills clustering. In some instances, the request for skills clustering may be received from a user or administrator of one or more of the social networking system 10 and the skills clustering machine 22. In various embodiments, the request for skills clustering may be generated and the operations of the method 600 may be performed as an automated function of the social networking system 10 as part of maintenance procedures to ensure that skills clusters are current with member generated skills and member profile updates.

In operation 614, the clustering module 208 generates a set of skills clusters for the set of skills. Operation 614 may be performed similarly to or the same as operation 308. In operation 616, the validation module 210 validates a skills cluster of the set of skills clusters to generate a validated skills cluster. Operation 616 may be performed similarly to or the same as operation 310. In operation 618, the presentation module 212 causes presentation of data representing the validated skills cluster at a client device (e.g., the client device 8). Operation 618 may be performed similarly to or the same as operation 312.

Figure 7:
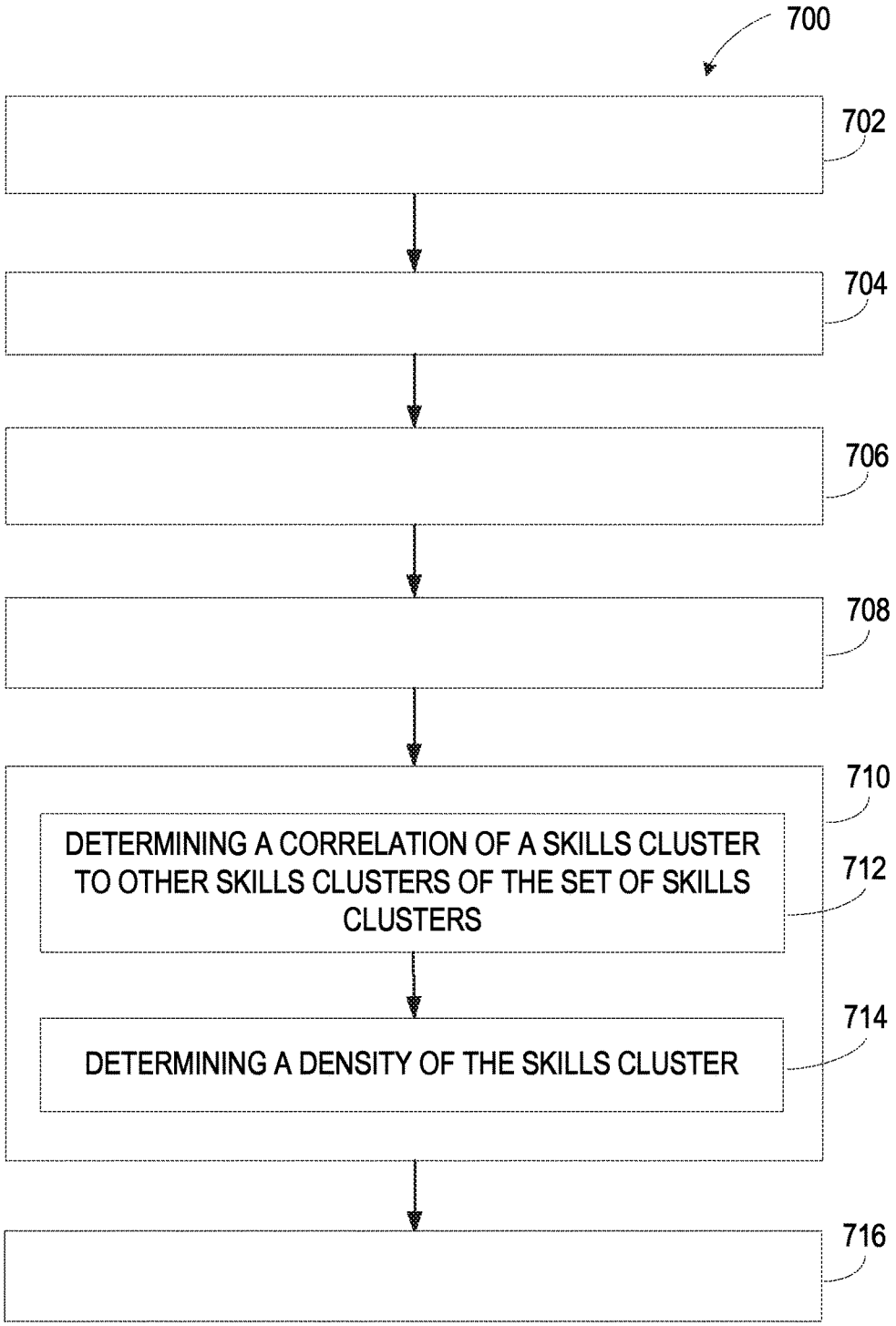
FIG. 7 is a flow diagram illustrating an example method of skills cluster validation during automated skills cluster generation.

FIG. 7 is a flow diagram illustrating an example method 700 of skills cluster validation during automated skills cluster generation, consistent with various embodiments described herein. The method 700 may be performed at least in part by, for example, the skills clustering machine 22 illustrated in FIG. 2 (or an apparatus having similar modules, such as one or more client machines or application servers). In some embodiments, the method 700 includes one or more operations from the method 300. For example, as shown, the method 700 includes operations 702, 704, 706, and 708 which may be performed similarly to or the same as operations 302, 304, 306, and 308, respectively.

In operation 710, the validation module 210 validates a skills cluster of the set of skills clusters to generate a validated skills cluster. As shown in FIG. 7, the operation 710 includes sub-operations based on generating the set of skills clusters, automatically validating, by the skills clustering machine 22. In operation 712, the validation module 210 determines a correlation of the skills cluster to other skills clusters of the set of skills clusters. In various embodiments, the validation module 210 determines the correlation of the skills within the skills cluster by silhouette indexing operations modeling relationships among the skills of the skills cluster.

Given the skills cluster, the validation module 210 determine how well a skill is assigned to the skills cluster and define a dissimilarity threshold or similarity threshold. The validation module 210 may generate a similarity score for each skill within the cluster as a metric for measuring the similarity of the skill to other skills or, more broadly, the skills cluster. In some embodiments, a similarity score for a skill, which is below the dissimilarity score, indicates a tight clustering or appropriate similarity of the skill to the skills cluster or other skills within the skills cluster.

In some instances, where the validation module 210 identifies one or more skills with dissimilarity scores which exceed the dissimilarity threshold, the validation module 210 removes the identified one or more skills from the skills cluster. The validation module 210 may transmit a notification to the clustering module 208 indicative of the identified one or more skills removed from the skills cluster. The identified one or more skills may be flagged for later processing by the clustering module 208 to determine one or more skills clusters to which the identified one or more skills will be reassigned.

In operation 714, the validation module 210 determines a density of the skills cluster. The validation module 210 may determine density by performing one or more mathematical operations on a set of dissimilarity scores generated for the skills within the skills cluster. For example, the validation module 210 may average the set of dissimilarity scores for the skills cluster. Similar to the individual similarity scores, an averaged dissimilarity score which is lower or below a predetermined cluster score, a dissimilarity threshold for the skills cluster, indicates a tight cluster or appropriate fit of the skills within the skills cluster.

In operation 716, the presentation module 212 causes presentation of data representing the validated skills cluster at a client device (e.g., the client device 8). In some embodiments, operation 716 may be performed similarly to or the same as operation 312.

Figure 8:
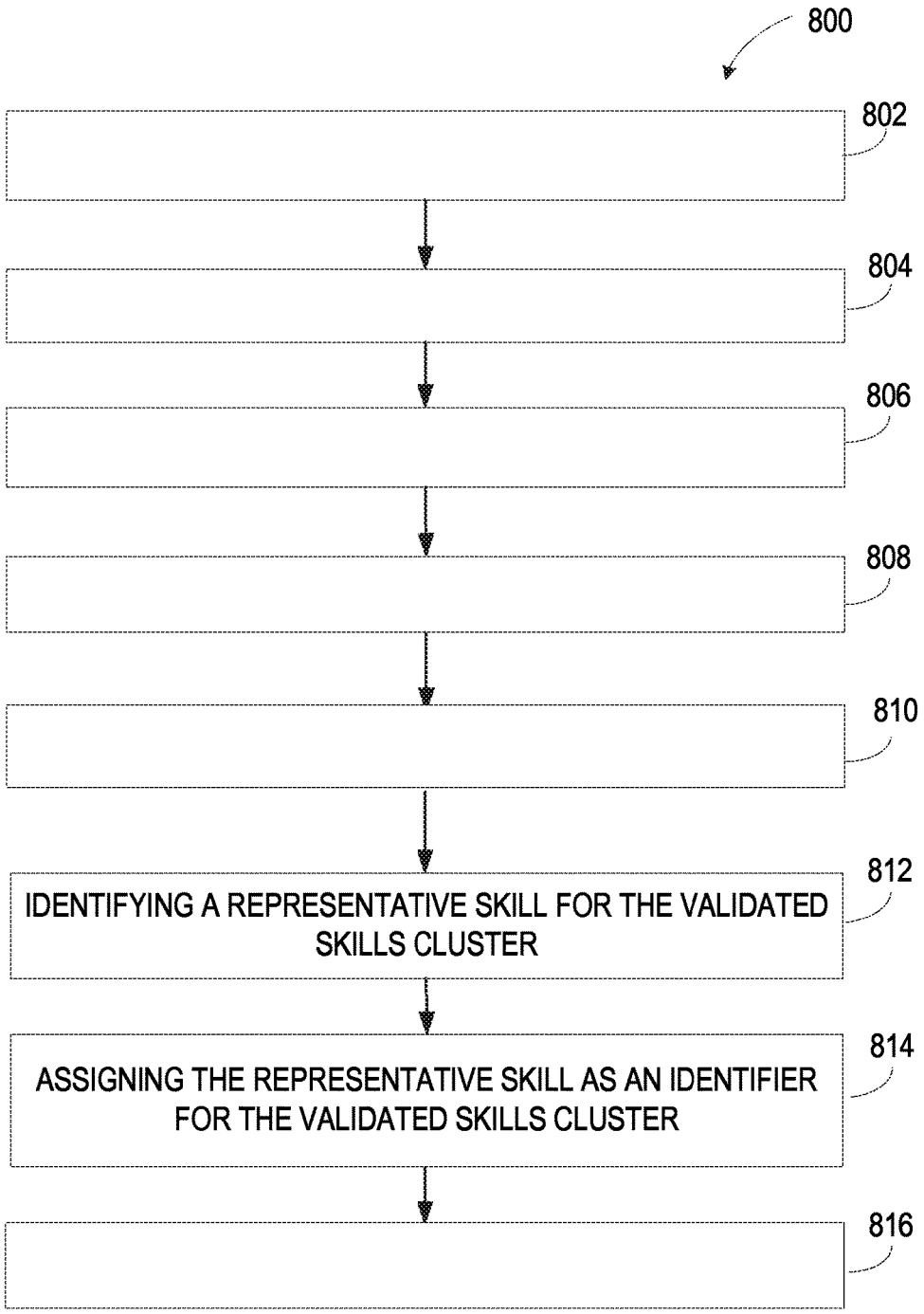
FIG. 8 is a flow diagram illustrating an example method of identifying validated skills clusters during automated skills cluster generation.

FIG. 8 is a flow diagram illustrating an example method 800 of identifying validated skills clusters during automated skills cluster generation, consistent with various embodiments described herein. The method 800 may be performed at least in part by, for example, the skills clustering machine 22 illustrated in FIG. 2 (or an apparatus having similar modules, such as one or more client machines or application servers). In some embodiments, the method 800 includes one or more operations from the method 300. For example, as shown, the method 800 includes operations 802, 804, 806, 808, and 810 which may be performed similarly to or the same as operations 302, 304, 306, 308, and 310 respectively.

In operation 812, the identification module 206 identifies a representative skill for the validated skills cluster. In various embodiments, the identification module 206 identifies a representative skill based on similarity scores generated for the skills within the validated skills cluster. For example, where the validation module 210 generates dissimilarity scores, as described in operation 712, the identification module 206 may identify the skill having the lowest dissimilarity score as a representative skill for the validated skills cluster. In some instances, the identification module 206 may parse the skills matrix to determine the skill within the validated skills cluster having the highest number of co-occurrences, as an absolute value, or the highest number of co-occurrences with other skills of the validated skills cluster as the representative skill for the validated skills cluster. For example, the identification module 206 may identify the skill with the highest number of co-occurrences with other skills of the validated skills cluster as being the most prominent or visible skill within the validated skills cluster.

In some embodiments, the identification module 206 identifies the representative skill based on relationships among the skills. For example, in some embodiments, the set of standardized skills are arranged in a hierarchical data structure stored on the database 16. The identification module 206 may identify the skills within the validated skills cluster and compare the identified skills with a hierarchical skills database stored on the database 16. The identification module 206 may identify the representative skill as a skill in the hierarchical skills database, and included among the skills of the validated skills cluster, having the highest level of generality. For example, for a validated skills cluster including computer programming languages, software engineering management, code debugging, computer and program testing, embedded systems, and information technology infrastructure and system management, the identification module 206 may identify a representative skill as "computer" based on the breadth of skills presented within the skills cluster. As a result, in some instances, the representative skill may be the least general skill which encompasses, within its hierarchical subordinates, all of the other skills within the validated skills cluster.

The hierarchical data structure may organize the member generated skills and standardized skills such that the lowest level of the hierarchy contains the member generated skills. Superior levels of the hierarchy include the set of standardized skills in a level above the member generated skills. A set of core skills are superior to the set of standardized skills. The set of core skills describe skills which cover a majority of the members of the social networking system 10. For example the set of core skills may represent generalized skill representations which cover ninety-nine percent of the members and ninety-three percent of the skills mentioned within the member profiles (e.g., member generated skills and standardized skills). Each level of the hierarchy may be understood as including a more generalized representation or wording for skills included in its subordinate levels.

In various embodiments, the identification module 206 may identify a set of representative skills, and cause presentation of the set of representative skills to the client device 8 for selection by an administrator or user of the social networking system 10.

In operation 814, the identification module 206 assigns the representative skill as an identifier for the validated skills cluster. In some instances, the representative skill is assigned to the validated skills cluster by labeling a file, database, or data structure representative of the validated skills cluster with the representative skill. The representative skill may be assigned as the identifier for the validated skill cluster based on entry of the representative skill in a metadata file or tag associated with the validated skills cluster. In some embodiments, the skills (e.g., data or metadata representing the skills) of the validated skills cluster may be modified to include a reference to the representative skill and the validated skills cluster. For example, a metadata tag may be associated with a skill of the validated skills cluster to identify the validated skills cluster of which the skill is a part and the representative skill as the identifier of the validated skills cluster.

Figure 9:
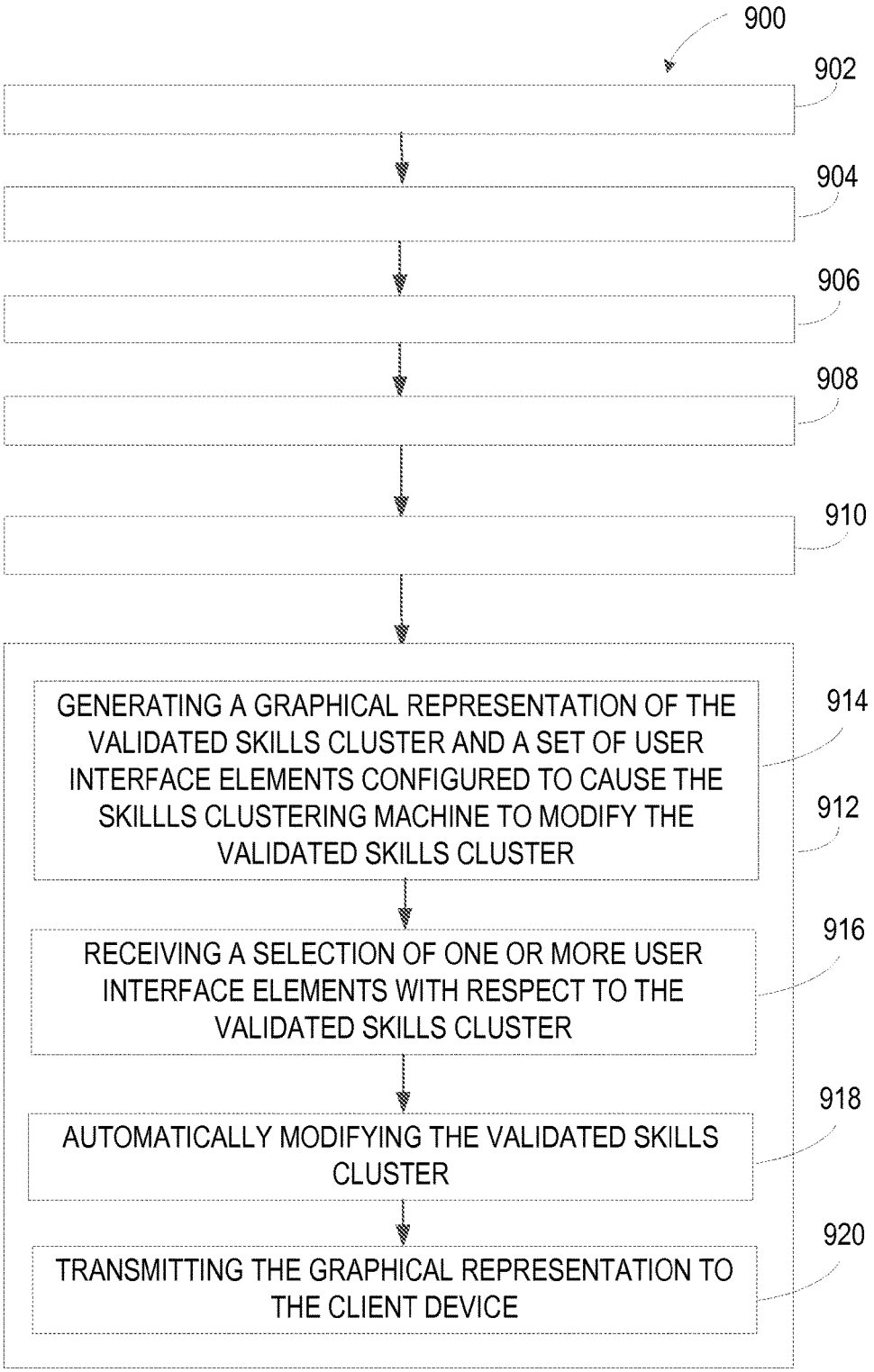
FIG. 9 is a flow diagram illustrating an example method of generating tailored notifications for cluster revision of validated skills clusters.

FIG. 9 is a flow diagram illustrating an example method 900 of generating tailored notifications for cluster revision of validated skills clusters, consistent with various embodiments described herein. The method 900 may be performed at least in part by, for example, the skills clustering machine 22 illustrated in FIG. 2 (or an apparatus having similar modules, such as one or more client machines or application servers). In some embodiments, the method 900 includes one or more operations from the method 300. For example, as shown, the method 900 includes operations 902, 904, 906, 908, and 910 which may be performed similarly to or the same as operations 302, 304, 306, 308, and 310 respectively.

In operation 912, the presentation module 212 causes presentation of data representing the validated skills cluster at a client device (e.g., the client device 8). The operation 912 may be performed using one or more sub-operations. As shown, in operation 914, the presentation module 212 generates a graphical representation of the validated skills cluster. In some example embodiments, the presentation module 212 generates a graph representative of the validated skills cluster. In some instances the graph is formed from a set of nodes, representing the set of skills of the validated skills cluster, interspersed within the graph. A node representing a skill of the validated skills cluster may graphically or textually identify the represented skill. For example, in some instances, the presentation module 212 formats the nodes to include textual information identifying a skill when presented within the graph. In some instances, the textual information is presented when a cursor, mouse icon, finger, or other input device or representation of a position of an input device is positioned (e.g., hovers) over the node. The nodes may be connected with edges, such that each an edge represents at least one co-occurrence between two skills. In some instances, the relative thickness, color, shape, line type, or other attributes of the edges are generated to reflect an amount of frequency of co-occurrences between two of the skills. For example, edges may be presented in a range of colors, such as blue to red. Edges representing fewer co-occurrences (e.g., a number falling below a predetermined threshold) may be represented within the range of colors which appear blue in hue, while edges representing a greater number of co-occurrences are represented within the range of colors which appear red in hue.

In various embodiments, the graphical representation of the validated skills cluster is generated within a graphical user interface with a set of user interface elements. For example, the set of user interface elements may include buttons, radio buttons, switches, sliders, or other selectable user interface elements. In some embodiments, individual nodes of the graph may be presented with selectable user interface elements when a cursor or finger is positioned over the node. The set of user interface elements may be configured to cause the clustering module 208, the validation module 210, or the presentation module 212 to edit or otherwise modify one or more of the validated skills cluster and the graphical representation of the validated skills cluster.

In operation 916, user interface 14 receives a selection of one or more user interface elements of the set of user interface elements with respect to the validated skills cluster from the client device 8. The user interface 14 may receive the selection via a network from the client device 8, and pass the selection or data representative of the selection to one or more of the clustering module 208, the validation module 210, or the presentation module 212. In some embodiments, the user interface 14, transmitting the selection of the one or more user interface elements, causes the skills clustering machine 22 to configure one or more processor to perform a set of operations based on an identified type or characteristic of the selection. For example, in some embodiments, where the selection indicates removal of one or more skills from the validated skills cluster, the selection, transmitted from the user interface 14 to the skills clustering machine 22 causes the skills clustering machine 22 to configure a processor associated with the skills clustering machine 22 to be configured to perform operations as part of the clustering module 208 or validation module 210.

In operation 918, the validation module 210 modifies the validated skills cluster by generating a modified skills cluster from the validated skills cluster. The validation module 210 then validates that modified skills cluster. For example, as stated above, where the selection indicates removal of one or more skills from the validated skills cluster, the validation module 210 or the clustering module 208 removes the selected one or more skills from the validated skills cluster. In some instances, removal of a skill from the validated skills cluster may include deletion of the skill from a database or data structure representative of the validated skills cluster to generate the modified skills cluster. The validation module 210 may then validate the modified skills cluster in a manner similar to the operations 310 or 510, described in detail above.

In operation 920, the presentation module 212 transmits the graphical representation to the client device 8 across a network. Operation 920 may be performed similarly to or the same as operations 312, 616, or 716

Figure 10:
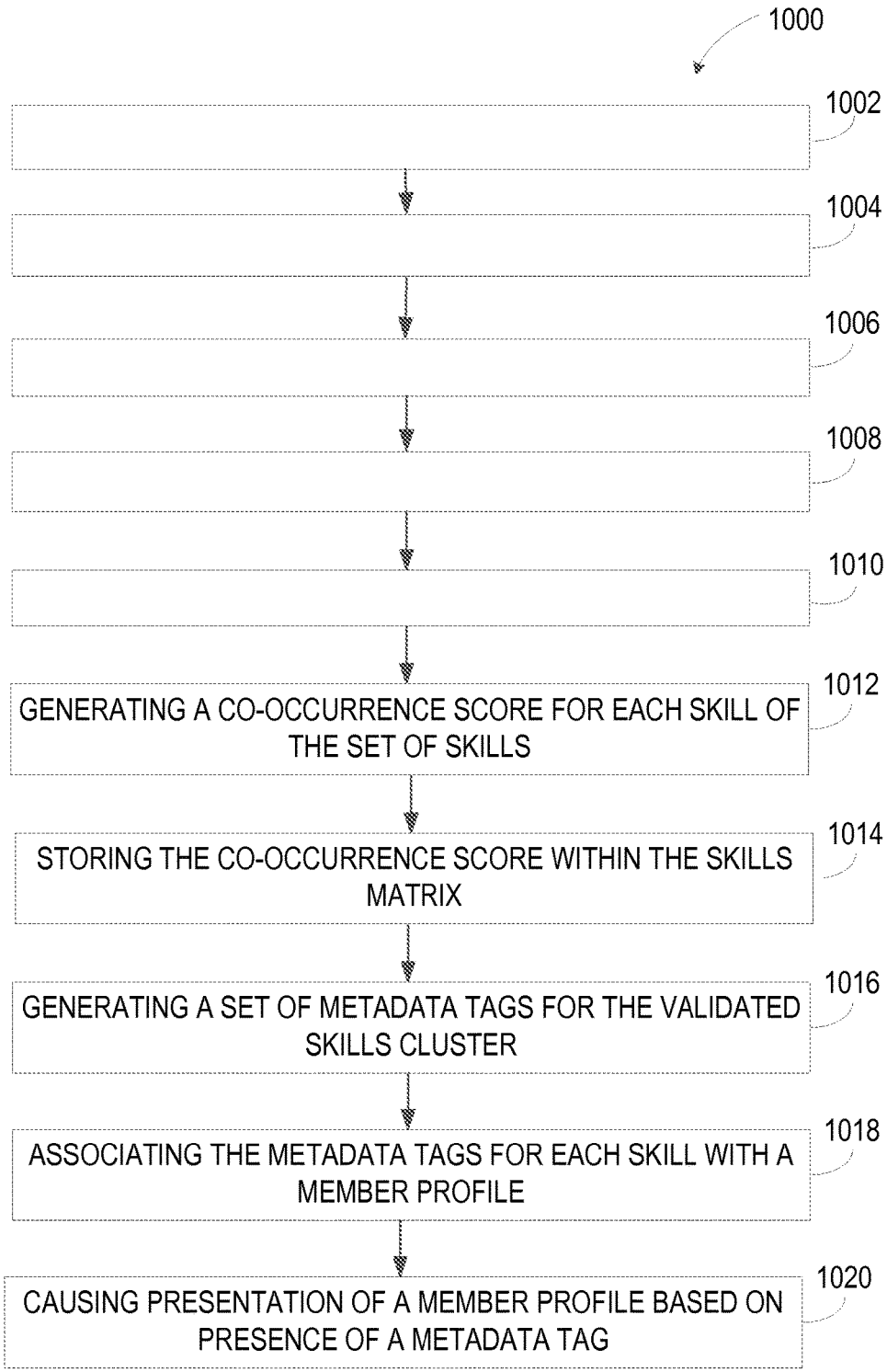
FIG. 10 is a flow diagram illustrating generating tailored user interface presentations using validated skills clusters.

FIG. 10 is a flow diagram illustrating generating tailored user interface presentations using validated skills clusters, consistent with various embodiments described herein. The method 1000 may be performed at least in part by, for example, the skills clustering machine 22 illustrated in FIG. 2 (or an apparatus having similar modules, such as one or more client machines or application servers). In some embodiments, the method 1000 includes one or more operations from the method 300. For example, as shown, the method 1000 includes operations 1002, 1004, 1006, 1008, and 1010 which may be performed similarly to or the same as operations 302, 304, 306, 308, and 310 respectively.

In operation 1012, the identification module 206 generates a co-occurrence score for each skill of the set of skills. In some embodiments, the co-occurrence score may represent pairwise similarities among two or more skills of the set of skills. In some instances, the co-occurrence score indicates a frequency with which two or more skills co-occur within the set of member profiles in order to represent the pairwise similarity of the two or more skills. A co-occurrence score for a first skill may correspond to a co-occurrence score for a second skill indicating their co-occurrence and a measure of the similarity between the first and second skills. In some instances, the co-occurrence score is generated using one or more operations of collaborative filtering. For example, the identification module 206 may generate co-occurrence scores using memory-based collaborative filtering to compute a similarity between skills. In some embodiments, the identification module 206 generates co-occurrence scores using cosine similarity, defining cosine similarities between two skills. The identification module 206 may generate co-occurrence scores using the Jaccard index to either measure the similarity or dissimilarity among two or more co-occurring skills.

In operation 1014, the clustering module 208 or the matrix module 204 stores the co-occurrence score within the skills matrix. In some embodiments, the co-occurrence scores may be stored in such a way as to indicate the two skills for which the co-occurrence score measures similarity. For example, where the skills matrix organizes the skills into a data table with values representing the intersection of two skills, the co-occurrence score may be stored as the value for that intersection. In some embodiments, the skills matrix may be distributed as link, references, or tags stored in data representative of the skill or metadata associated with the skill. As such, the co-occurrence score may be stored as a modification of the data representing the skill or metadata associated with the skill. As such, in various embodiments, the clustering module 208 may store the co-occurrence scores in the database 16 in the skills matrix, in member profiles, or any other suitable file, database, or data structure.

In operation 1016, the identification module 206 generates a set of metadata tags for the validated skills cluster. Each metadata tag of the set of metadata tags may include an identifier for a first skill and a co-occurrence for the first skill. In some instances, the metadata tag includes an identification of a second skill associated with the co-occurrence score for the first skill.

In operation 1018, the identification module 206 associates the metadata tag for each skill in the validated skills cluster with a member profile in which the skill is included. The identification module 206 may associate a metadata tag with a member profile by storing all or part of the metadata tag within the member profile, generating a link between the member profile and a metadata file or data structure such that the link directs the system to one or more metadata tags associated with the member profile. In various embodiments, association of one or more metadata tags with a member profile represents a modification of the member profile which may not be visible to the member associated with the member profile or other members of the social networking system 10.

In operation 1020, the presentation module 212 causes presentation of a member profile of the set of member profiles in a search result based on a presence of a metadata tag of the set of metadata tags. The metadata tags may be used by the social networking system 10 to improve search results, identifying member profiles for inclusion in a set of search results by identifying one or more member generated skills, one or more standardized skills, or one or more metadata tags. In some embodiments, the metadata tags may be used to populate search results without identifying member profiles associated with the metadata tags. For example, a search query may specify a talent pool report to identify geographical locations for members of the social networking system 10 with certain characteristics, such as specified skills, graduation dates, job change statistics (e.g., recency of a job change, likelihood of being contacted by a recruiter, or job titles and mobility within job titles of a career path), and distribution of skill sets among organizations or within an organization. Further, the metadata tags may be used to identify a number of professionals with a certain skill or set of skills within an area and the competition for talent in that area. In some instance, competition for talent may be considered a function of a number of companies in a geographic region employing members having a specified skill, a number of members within a period of time who move to or away from that geographic area and have the specified skill set, a number of members with the specified skill set who have changed jobs within a determined period of time, a number of members with a specified skill set who join or leave the workforce in a determined period of time (e.g., members recently graduating or retiring).

The various operations of the example methods described herein may be performed, at least partially, by one or more processors that are temporarily configured (e.g., by software instructions) or permanently configured to perform the relevant operations. Whether temporarily or permanently configured, such processors may constitute processor-implemented modules or objects that operate to perform one or more operations or functions. The modules and objects referred to herein may, in some example embodiments, comprise processor-implemented modules and/or objects.

Similarly, the methods described herein may be at least partially processor-implemented. For example, at least some of the operations of a method may be performed by one or more processors or processor-implemented modules. The performance of certain operations may be distributed among the one or more processors, not only residing within a single machine or computer, but deployed across a number of machines or computers. In some example embodiments, the processor or processors may be located in a single location (e.g., within a home environment, an office environment or at a server farm), while in other embodiments the processors may be distributed across a number of locations.

The one or more processors may also operate to support performance of the relevant operations in a "cloud computing" environment or within the context of "software as a service" (SaaS). For example, at least some of the operations may be performed by a group of computers (as examples of machines including processors), these operations being accessible via a network (e.g., the Internet) and via one or more appropriate interfaces (e.g., Application Program Interfaces (APIs)).

Figure 11:
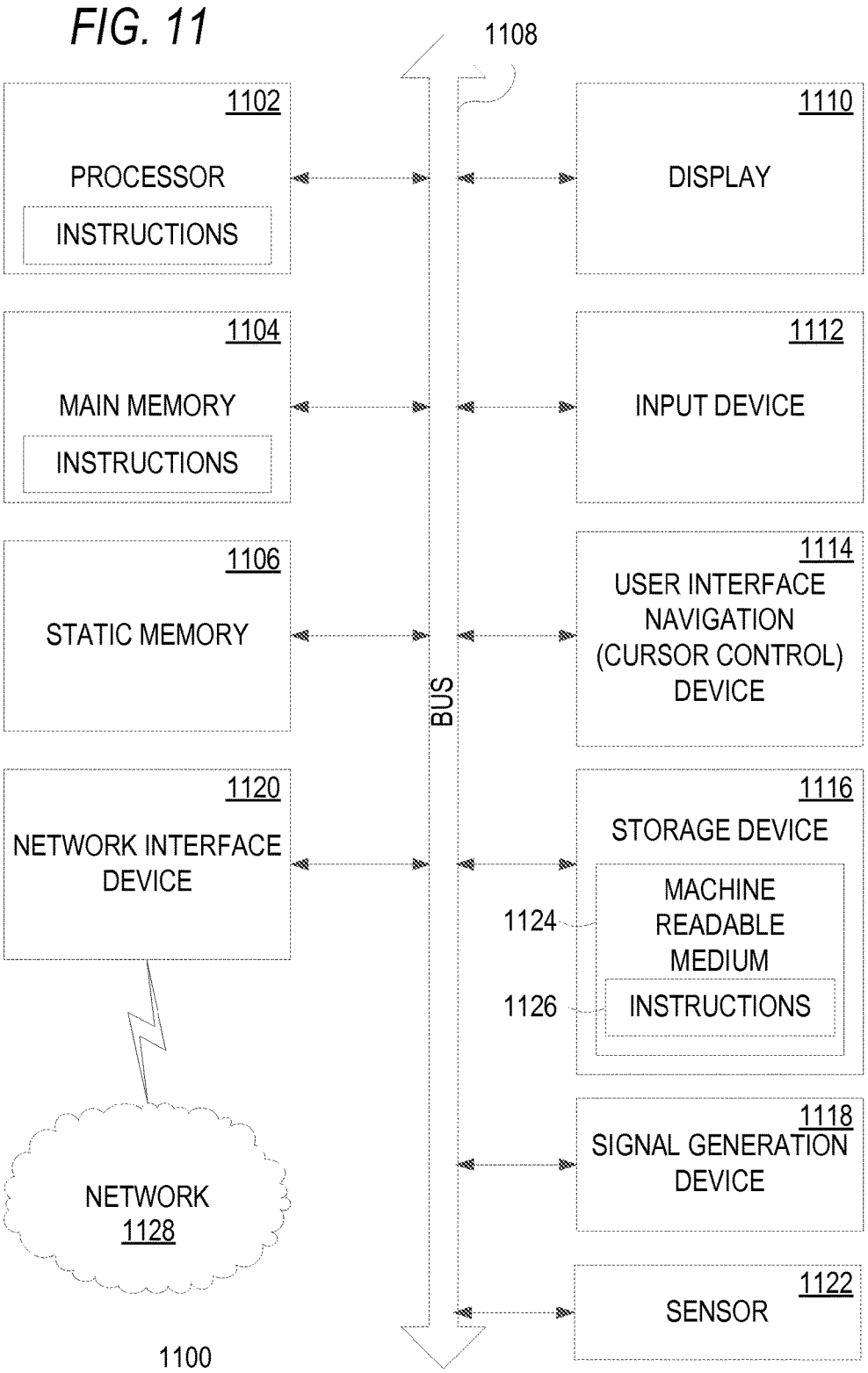
FIG. 11 is a block diagram of a machine in the form of a computing device within which a set of instructions, for causing the machine to perform any one or more of the methodologies discussed herein, may be executed.

FIG. 11 is a block diagram of a machine in the form of a computing device within which a set of instructions, for causing the machine to perform any one or more of the methodologies discussed herein, may be executed. For example, the computing device may be a server functioning as the skills clustering machine 22. In some instances the computing device may be a set of similar computing devices storing instructions capable of configuring a processor of the computing device as one or more of the modules (hardware-software implemented modules) described above. The configuration of a module, even for a period of time, causes the computing device to act as a special purpose computing device for performing one or more operations associated with the module, as described in the present disclosure. In some embodiments, the computing device may function as the social networking system 10 with portions (e.g., hardware and instructions) partitioned to function as one or more of the modules, interfaces, or systems described above during specified operations associated with those aspects of the modules, interfaces, and systems.

In alternative embodiments, the machine operates as a standalone device or may be connected (e.g., networked) to other machines. In a networked deployment, the machine may operate in the capacity of a server or a client machine in a client-server network environment, or as a peer machine in peer-to-peer (or distributed) network environment. In a various embodiments, the machine will be a server computer, however, in alternative embodiments, the machine may be a personal computer (PC), a tablet PC, a set-top box (STB), a Personal Digital Assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1100 includes a processor 1102 (e.g., a central processing unit (CPU), a graphics processing unit (GPU) or both), a main memory 1104 and a static memory 1106, which communicate with each other via a bus 1108. The computer system 1100 may further include a display unit 1110, an alphanumeric input device 1112 (e.g., a keyboard), and a user interface (UI) navigation device 1114 (e.g., a mouse). In one embodiment, the display, input device and cursor control device are a touch screen display. The computer system 1100 may additionally include a storage device 1116 (e.g., drive unit), a signal generation device 1118 (e.g., a speaker), a network interface device 1120, and one or more sensors 1122, such as a global positioning system sensor, compass, accelerometer, or other sensor.

The drive unit 1116 includes a machine-readable medium 1124 on which is stored one or more sets of instructions and data structures (e.g., software 1126) embodying or utilized by any one or more of the methodologies or functions described herein. The software 1126 (e.g. processor executable instructions) may also reside, completely or at least partially, within the main memory 1104 (e.g., non-transitory machine-readable storage medium) and/or within the processor 1102 during execution thereof by the computer system 1100, the main memory 1104 and the processor 1102 also constituting machine-readable media.

While the machine-readable medium 1124 is illustrated in an example embodiment to be a single medium, the term "machine-readable medium" may include a single medium or multiple media (e.g., a centralized or distributed database, and/or associated caches and servers) that store the one or more instructions. The term "machine-readable medium" shall also be taken to include any tangible medium that is capable of storing, encoding or carrying instructions for execution by the machine and that cause the machine to perform any one or more of the methodologies of the present disclosure, or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including by way of example semiconductor memory devices, e.g., EPROM, EEPROM, and flash memory devices; magnetic disks such as internal hard disks and removable disks; magneto-optical disks; and CD-ROM and DVD-ROM disks.

The software 1126 may further be transmitted or received over a communications network 1128 using a transmission medium via the network interface device 1120 utilizing any one of a number of well-known transfer protocols (e.g., HTTP). Examples of communication networks include a local area network ("LAN"), a wide area network ("WAN"), the Internet, mobile telephone networks, Plain Old Telephone (POTS) networks, and wireless data networks (e.g., Wi-Fi® and WiMax® networks). The term "transmission medium" shall be taken to include any intangible medium that is capable of storing, encoding or carrying instructions for execution by the machine, and includes digital or analog communications signals or other intangible medium to facilitate communication of such software.

Although embodiments have been described with reference to specific examples, it will be evident that various modifications and changes may be made to these embodiments without departing from the broader scope of the inventive concepts of the present disclosure. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

What is claimed is:

1. A method comprising:

generating an interactive graphical user interface for modifying a validated skills cluster, the validated skills cluster representing an automatically validated set of co-occurrences among a set of skills associated with a set of member profiles of a social networking system, the generating of the interactive graphical user interface comprising:

accessing the set of skills in a database of the social networking system;

generating a skills matrix for the set of skills stored on the database, the generating of the skills matrix including determining values representing co-occurrences between each skill in the set of skills and other skills in the set of skills;

automatically generating, by the skills clustering machine, a set of skills clusters for the set of skills, the generating including using the skills matrix as an input to a spectral clustering algorithm;

based on the generating of the set of skills clusters, automatically validating, by the skills clustering machine, a skills cluster of the set of skills clusters to generate the validated skills cluster, the validating including applying a rule for an inconsistent skill that was previously incorporated via machine learning into the skills clustering machine;

causing presentation of the interactive graphical user interface at a client device, the interactive graphical user interface including a graphical representation of the validated skills cluster, and user interface elements for modifying the graphical representation of the validated skills cluster;

generating, by the skills clustering machine, a modified validated skills cluster based on the modifying of the graphical representation of the validated skills cluster; and generating, by the skills clustering machine, a search result based on the modified validated skills cluster, the search result including a subset of the set of member profiles in a geographical area having characteristics specified in a search query, the search result excluding a false positive based on the identified rule; and flagging the false positive for reassignment by the skills clustering machine to a different skills cluster of the plurality of skills clusters.

2. The method of claim 1, wherein the set of skills is a set of standardized skills representing of a set of member generated skills received from one or more members of the social networking system, the set of member generated skills included within the set of member profiles.

3. The method of claim 2, wherein identifying the set of co-occurrences among the set of skills further comprises:

identifying a first set of co-occurrences among the set of member generated skills within the set of member profiles;

identifying a standardized skill associated with each of the member generated skills identified within the first set of co-occurrences; and based on the identifying the first set of co-occurrences and identifying the standardized skill associated with each of the member generated skills, identifying a second set of co-occurrences for the set of standardized skills.

4. The method of claim 1 further comprising:

generating a co-occurrence score for each skill of the set of skills; and storing the co-occurrence score within the skills matrix.

5. The method of claim 4, wherein the co-occurrence score indicates a frequency with which two or more skills co-occur within the set of member profiles, the co-occurrence score for the two or more skills is stored in the skills matrix at an intersection of two skills of the two or more skills.

6. The method of claim 4 further comprising:

generating a set of metadata tags for the validated skills cluster, each metadata tag of the set of metadata tags including an identifier for a skill and the co-occurrence score for the skill; and associating the metadata tag for each skill in the validated skills cluster with a member profile in which the skill is included.

7. The method of claim 6 further comprising:

causing presentation of a member profile of the set of member profiles in a search result based on a presence of a metadata tag of the set of metadata tags.

8. The method of claim 1, wherein the interactive graphical user interface includes user interface elements for presenting a subset of skills included in the validated skills cluster.

9. The method of claim 1 further comprises:

receiving a selection of one or more user interface elements of the set of user interface elements with respect to the validated skills cluster from the client device; and based on receiving the selection, automatically modifying the validated skills cluster by generating a modified skills cluster from the validated skills cluster, and validating the modified skills cluster.

10. The method of claim 1 further comprising:

identifying a representative skill for the validated skills cluster; and assigning the representative skill as an identifier for the validated skills cluster.

11. The method of claim 1, where in validating the skills cluster of the set of skills clusters further comprises:

determining a density of the skills cluster; and determining a correlation of the skills cluster to other skills clusters of the set of skills clusters.

12. A system comprising:

one or more computer processors;

one or more memory devices holding an instruction set executable by the one or more computer processors to cause the system to perform operations generating an interactive graphical user interface for modifying a validated skills cluster, the validated skills cluster representing an automatically validated set of co-occurrences among a set of skills associated with a set of member profiles of a social networking system, the operations comprising:

accessing the set of skills in a database of the social networking system;

generating a skills matrix for the set of skills stored on the database, the generating of the skills matrix including determining values representing co-occurrences between each skill in the set of skills and other skills in the set of skills;

automatically generating, by the skills clustering machine, a set of skills clusters for the set of skills, the generating including using the skills matrix as an input to a spectral clustering algorithm;

based on the generating of the set of skills clusters, automatically validating, by the skills clustering machine, a skills cluster of the set of skills clusters to generate the validated skills cluster, the validating including applying a rule for an inconsistent skill that was previously incorporated via machine learning into the skills clustering machine;

causing presentation of the interactive graphical user interface at a client device, the interactive graphical user interface including a graphical representation of the validated skills cluster, and user interface elements for modifying the graphical representation of the validated skills cluster;

generating, by the skills clustering machine, a modified validated skills cluster based on the modifying of the graphical representation of the validated skills cluster; and generating, by the skills clustering machine, a search result based on the modified validated skills cluster, the search result including a subset of the set of member profiles in a geographical area having characteristics specified in a search query, the search result excluding a false positive based on the identified rule; and flagging the false positive for reassignment b the skills clustering machine to a different skills cluster of the plurality of skills clusters.

13. The system of claim 12, wherein the instruction set causes the system to perform operations comprising:

generating a co-occurrence score for each skill of the set of skills; and storing the co-occurrence score within the skills matrix.

14. The system of claim 13, wherein the instruction set causes the system to perform operations comprising:

generating a set of metadata tags for the validated skills cluster, each metadata tag of the set of metadata tags including an identifier for a skill and the co-occurrence score for the skill; and associating the metadata tag for each skill in the validated skills cluster with a member profile in which the skill is included.

15. The system of claim 12, wherein modifying of the validated skills cluster includes generating a modified skills cluster from the validated skills cluster, and validating the modified skills cluster.

16. A non-transitory machine-readable storage medium comprising processor executable instructions that, when executed by one or more processors of a machine, cause the machine to perform operations for generating an interactive graphical user interface for modifying a validated skills cluster, the validated skills cluster representing an automatically validated set of co-occurrences among a set of skills associated with a set of member profiles of a social networking system, the operations comprising:

accessing the set of skills in a database of the social networking system;

generating a skills matrix for the set of skills stored on the database, the generating of the skills matrix including determining values representing co-occurrences between each skill in the set of skills and other skills in the set of skills;

automatically generating, by the skills clustering machine, a set of skills clusters for the set of skills, the generating including using the skills matrix as an input to a spectral clustering algorithm;

based on the generating of the set of skills clusters, automatically validating, by the skills clustering machine, a skills cluster of the set of skills clusters to generate the validated skills cluster, the validating including applying a rule for an inconsistent skill that was previously incorporated via machine learning into the skills clustering machine;

causing presentation of the interactive graphical user interface at a client device, the interactive graphical user interface including a graphical representation of the validated skills cluster, and user interface elements for modifying the graphical representation of the validated skills cluster;

generating, by the skills clustering machine a modified validated skills cluster based on the modifying of the graphical representation of the validated skills cluster; and generating, by the skills clustering machine, a search result based on the modified validated skills cluster, the search result including a subset of the set of member profiles in a geographical area having characteristics specified in a search query, the search result excluding a false positive based on the identified rule; and flagging the false positive for reassignment by the skills clustering machine to a different skills cluster of the plurality of skills clusters.

17. The non-transitory machine-readable storage medium of claim 16, wherein the modifying the validated skills cluster includes generating a modified skills cluster from the validated skills cluster, and validating the modified skills cluster.

* * * * *